US007667722B2

(12) United States Patent
Honma et al.

(10) Patent No.: US 7,667,722 B2
(45) Date of Patent: Feb. 23, 2010

(54) THERMAL HEAD AND METHOD OF CONTROLLING THERMAL HEAD

(75) Inventors: Hiroe Honma, Kanagawa (JP); Takaaki Murakami, Tokyo (JP)

(73) Assignee: Sony Corporation, Tokyo (JP)

( * ) Notice: Subject to any disclaimer, the term of this patent is extended or adjusted under 35 U.S.C. 154(b) by 64 days.

(21) Appl. No.: 11/942,472

(22) Filed: Nov. 19, 2007

(65) Prior Publication Data

US 2008/0117275 A1 May 22, 2008

(30) Foreign Application Priority Data

Nov. 20, 2006 (JP) ..... 2006-313646

(51) Int. Cl.
*B41J 2/355* (2006.01)

(52) U.S. Cl. ..... 347/211

(58) Field of Classification Search ..... 347/200, 347/211

See application file for complete search history.

(56) References Cited

U.S. PATENT DOCUMENTS

2008/0117276 A1* 5/2008 Murakami et al. ..... 347/202

FOREIGN PATENT DOCUMENTS

| | | |
|---|---|---|
| JP | 59-190872 | 10/1984 |
| JP | 2002-370398 | 12/2002 |
| JP | 2006-205520 | 8/2006 |

OTHER PUBLICATIONS

Macchine_translated translation of JP 2006-205520 cited in the IDS filed Nov. 19, 2007.*
Machine-translated translation of JP 2002-370398 cited in the IDS filed Nov. 19, 2007.*

* cited by examiner

*Primary Examiner*—Huan H Tran
(74) *Attorney, Agent, or Firm*—Sonnenschein Nath & Rosenthal LLP

(57) ABSTRACT

A thermal head has plural heat generating elements arrayed therein in a main scanning direction to form a heat generating element row, causes the respective heat generating elements to generate heat while conveying a recording medium in a sub-scanning direction, and forms plural dot lines in the main scanning direction on the recording medium to record an image. A plurality of the heat generating element rows are arrayed in the sub-scanning direction. Respective nth (n is a natural number) heat generating elements among the heat generating elements in the respective heat generating element rows can sharingly form a dot in the same position in an identical dot line according to independent driving for each of the heat generating element rows.

7 Claims, 11 Drawing Sheets

DECOMPOSE image (x) INTO DATA FOR HEAT ELEMENT L

CALCULATION (COMBINATION) OF
COLOR DEVELOPMENT CURVE image L (x)
BY DATA FOR HEAT ELEMENT L image' (x) = image (x) − image L (x)

DECOMPOSE image' (x) INTO DATA FOR HEAT ELEMENT S

CALCULATION (COMBINATION) OF
COLOR DEVELOPMENT CURVE image S (x)
BY DATA FOR HEAT ELEMENT S image L (x) + image S (x)

THERMAL HEAD AND METHOD OF CONTROLLING THERMAL HEAD

CROSS-REFERENCES TO RELATED APPLICATIONS

The present invention contains subject matter related to Japanese Patent Application JP 2006-313646 filed in the Japanese Patent Office on Nov. 20, 2006, the entire contents of which being incorporated herein by reference.

BACKGROUND OF THE INVENTION

1. Field of the Invention

The present invention relates to a thermal head that has plural heat generating elements arrayed therein in a main scanning direction and causes, while conveying a recording medium in a sub-scanning direction, the respective heat generating elements to generate heat to record an image and the like on a recording medium and a method of controlling the thermal head, and, more particularly to a technique adapted to obtain a high recording quality with high density.

2. Description of the Related Art

There is known a thermal printer including a thermal head that has plural heat elements (heat generating elements) arrayed therein and a platen roller provided to be opposed to the thermal head. In such a thermal printer, the thermal head is pressed against a recording medium (a recording sheet, etc.), which is conveyed onto the platen roller, via an ink ribbon to record an image and the like. When a thermosensitive recording medium is used, the ink ribbon is unnecessary.

FIG. 9 is a schematic diagram showing a main part of a general thermal printer 10 and is a diagram showing a section in a direction perpendicular to a rotating shaft 31 of a platen roller 30.

The thermal printer 10 shown in FIG. 9 includes a line-type thermal head 20 that has plural heat elements (not shown) arrayed therein in a line shape. A recording sheet 40 is held on the platen roller 30 and moved by the rotation of the platen roller 30.

A general image recorded by the thermal printer 10 has the shape of a horizontally long rectangle. Therefore, depending on a type of the thermal printer 10, a relatively short side (a direction perpendicular to the paper surface in FIG. 9) of the image is set as the length of the thermal head 20 and as the main scanning direction taking into account manufacturing cost and the like. The thermal printer 10 records the image on the recording sheet 40 while conveying the recording sheet 40 (feeding the recording sheet 40 in a right direction on the paper surface in FIG. 9) to form a relatively long side of the image, which is set as the sub-scanning direction.

The thermal head 20 is pressed against the recording sheet 40 via an ink ribbon 50 of a rolled cloth shape rolled between two ribbon cartridges 51. The thermal head 20 has a glaze 21, which is a convex portion standing in the vertical direction and extending in the main scanning direction. Plural heat elements are provided in a line shape along a top surface of the glaze 21. Therefore, during recording, the respective heat elements of the thermal head 20 press the recording sheet 40 with a high linear pressure.

When recording is actually executed, the respective heat elements are caused to generate heat in this state. Then, when the thermal printer 10 is a thermal printer of a sublimation transfer system, dye (thermofusible ink) of the ink ribbon 50 is transferred onto the recording sheet 40 in proportion to thermal energy generated by the heat elements. When the thermal printer 10 is a thermal printer of a thermofusible transfer system, pigment (thermofusible ink) of the ink ribbon 50 containing wax as a binder melts with thermal energy generated by the heat elements and adheres to be transferred on to the recording sheet 40. Therefore, one point of the thermofusible ink transferred onto the recording sheet 40 by the heat elements is formed as one dot.

To form a two-dimensional image with such a thermal head 20 of the line type, it is necessary to move the thermal head 20 and the recording sheet 40 relatively to each other. In other words, the thermal printer 10 sequentially forms dots while feeding the recording sheet 40 in the sub-scanning direction. Then, plural dots are arranged in the sub-scanning direction and changed to be continuous sets of dots one after another and a dot line is formed. Moreover, a plurality of the dot lines are formed in the main scanning direction by the plural heat elements arrayed in the main scanning direction. As a result, a two-dimensional image can be formed over the entire recording sheet 40.

As described above, the thermal printer 10 shown in FIG. 9 records an image on the recording sheet 40 by causing the respective heat elements to generate heat while feeding the recording sheet 40 in the sub-scanning direction using the thermal head 20 of the line type that has the plural heat elements arrayed therein in the main scanning direction. The resolution (the density of the dot line) of the thermal printer 10 depends on the number of heat elements arrayed in the main scanning direction of the thermal head 20.

FIG. 10 is a plan view showing a thermal head 200 in the past.

As shown in FIG. 10, in the thermal head 200, plural heat elements h (h1, h2, h3, h4, h5, h6, etc.) are arrayed in one row in the main scanning direction. A total number of the heat elements h is 2560. Therefore, the thermal head 200 can form 2560 dots per one line in the main scanning direction of the respective heat elements h. Since the resolution of the thermal head 200 is 300 DPI (dots per inch), the heat elements h are arranged side by side over 2560 dots/300 DPI=8.53 inches (216 mm).

FIG. 11 is a block diagram showing a method of controlling the thermal head 200 in the past shown in FIG. 10.

As shown in FIG. 11, in the thermal head 200 in the past, when data of an image that should be formed is inputted, heat history correction is applied to data for the heat elements h. Subsequently, the data for the heat elements h is modulated for driving of the heat elements h by PWM modulation. Dots are formed by the driving of the heat elements h based on the modulated data. An overall image is formed by sets of the dots.

In recent years, the thermal printer 10 (see FIG. 9) is demanded to form an image with high definition and, at the same time, at higher speed. For example, high recording speed equal to or less than 1 microsecond per one dot is demanded of the thermal printer 10. Such improvement of recording speed, which should be called as "ultrahigh speed recording", causes a temperature rise in the thermal head 200 (see FIG. 10).

The thermal head 200, which is originally a consumable product, is deteriorated more rapidly than usual because of an excessive temperature rise in the thermal head 200 (see FIG. 10) and the durable life of the thermal head 200 is extremely shortened. When the heat elements h (see FIG. 10) are arrayed at high density to form an image with high definition, a heat radiation property of the thermal head 200 is spoiled. As a result, a trailing track is formed regardless of the finish of recording, i.e., a so-called "tailing" occurs, because of the heat stored in the thermal head 200 and a recording quality falls.

To cope with such a problem, for example, there is known a technique for arranging the heat elements h (see FIG. 10), which are arranged in one row, in two rows and using one of the rows for preheating of the recording sheet 40 (see FIG. 9) and the ink ribbon 50 (see FIG. 9) or forming dot lines, which are sets of plural dots arranged in the sub-scanning direction, in two rows to thereby preventing an excessive temperature rise in the respective heat elements h.

For example, JP-A-2006-205520 (hereinafter, Patent Document 1) discloses a thermal head including plural printing dots arranged in a line shape and an electrode layer that supplies a current to the plural printing dots, wherein the thermal heads has a large-area heat element, which is thin and long in a traveling direction, on an entrance side in the traveling direction and has a small-area heat element on an exit side and, in the respective printing dots, plural heat generation areas having different heat generation peak temperatures are formed in a current supply direction when the current is supplied from the electrode layer.

JP-A-2002-370398 (hereinafter, Patent Document 2) discloses a thermal head in which plural heat elements are set in parallel to a direction in which thermal recording paper travels, a mechanism for controlling a temperature history (profile) of thermal energy is provided, and the respective heat elements are independently applied, whereby necessary energy can be supplied by a necessary amount.

SUMMARY OF THE INVENTION

However, in the technique disclosed in Patent Document 1, the thermal head only forms the plural heat generation areas having different heat generation peak temperatures in the current supply direction during the current supply and includes the thin long and large-area heat element and the small-area heat element. In other words, in the technique disclosed in Patent Document 1, it is difficult to independently drive the respective heat elements. Since one of the heat elements is affected by heat accumulation of the other, it is difficult to control the temperatures of the respective heat elements. Moreover, it is difficult to individually form dots with the respective heat elements.

In the technique disclosed in Patent Document 2, the plural heat elements are set in parallel to the direction in which thermal recording paper travels such that necessary energy can be supplied by a necessary amount. However, the thermal head does not form a dot in the same position sharingly between the respective heat elements to obtain a high recording quality with high density. In particular, to form a dot in the same position sharingly between two heat elements having different lengths, driving control that takes into account a difference in responsiveness of the respective heat elements (function sharing) is necessary. However, Patent Document 2 does not disclose such a point.

FIG. 12 is a conceptual diagram for explaining responsiveness (a density distribution) of another thermal head 220 in the past in which heat elements are arrayed in two rows as in the techniques disclosed in Patent Document 1 and Patent Document 2.

The thermal head 220 shown in FIG. 12 includes a heat element "s" short in the sub-scanning direction and a heat element "l" long in the sub-scanning direction. The heat element "s" and the heat element "l" can generate heat on the basis of driving patterns and form dots, respectively.

As shown in FIG. 12, although the driving patterns of the heat element "s" and the heat element "l" are identical with an image pattern, response patterns thereof change because of a difference in responsiveness between the heat element "s" and the heat element "l". Since the heat element "s" is relatively fast in response, the heat element "s" can generate heat with a high follow-up ability even in a portion of a short driving pattern and obtain necessary density. However, in a portion of a long driving pattern, the heat element "s" generates heat more than necessary because of the driving in a long time. A heat stress is caused in that portion (a portion indicated by a dotted line in which the response pattern exceeds the image pattern). Therefore, the heat element "s" is further deteriorated and the durable life thereof is shortened.

On the other hand, since the heat element l is relatively slow in response, the heat element l may be unable to respond in a portion of a short driving pattern. Since heat generation is insufficient, it is difficult to secure necessary density (density equivalent to the image pattern indicated by a dotted line). In a portion of a long driving pattern, necessary density can be obtained. However, since temperature does not fall even after the end of the driving pattern, "tailing" (a density distribution after the end of the image pattern indicated by the dotted line) remains and a recording quality falls.

In this way, even if the heat elements are arranged in two rows and the heat element "s" and the heat element "l" having different lengths are used, the problem of deterioration and the problem of "tailing" are left unsolved. Therefore, the effect realized by arranging the heat elements in two rows (the effect of preventing the fall in the recording quality while realizing high definition of a formed image and high-speed recording) is not sufficiently obtained.

Therefore, it is desirable to make it possible to sufficiently display the effect realized by arranging the heat elements in two rows, suppress further deterioration in the thermal head, and prevent the fall in a recording quality due to occurrence of "tailing" and the like and low density. It is also desirable to make it possible to control the thermal head to realize the effect.

According to an embodiment of the present invention, there is provided a thermal head that has plural heat generating elements arrayed therein in a main scanning direction to form a heat generating element row, causes the respective heat generating elements to generate heat while conveying a recording medium in a sub-scanning direction, and forms plural dot lines, which are sets of plural dots arranged in the sub-scanning direction, in the main scanning direction on the recording medium to record an image. A plurality of the heat generating element rows are arrayed in the sub-scanning direction. The respective heat generating elements in one of the heat generating element rows have length in the sub-scanning direction relatively different from that of the respective heat generating elements in the other heat generating element rows. Respective nth (n is a natural number) heat generating elements among the heat generating elements in the respective heat generating element rows can sharingly form a dot in the same position in an identical dot line according to independent driving for each of the heat generating element rows.

(Action)

According to the embodiment, the respective heat generating elements in one of the heat generating element rows have length in the sub-scanning direction relatively different from that of the respective heat generating elements in the other heat generating element rows. Respective nth (n is a natural number) heat generating elements among the heat generating elements in the respective heat generating element rows can sharingly form a dot in the same position in an identical dot line according to independent driving for each of the heat generating element rows. Therefore, it is possible to independently drive the heat generating elements having different lengths according to responsiveness of the heat generating elements such that the heat generating elements sharingly form a dot in the same position.

According to another embodiment of the present invention, there is provided a method of controlling a thermal head that has plural heat generating elements arrayed therein in a main scanning direction to form a heat generating element row, causes the respective heat generating elements to generate heat while conveying a recording medium in a sub-scanning direction, and forms plural dot lines, which are sets of plural dots arranged in the sub-scanning direction, in the main scanning direction on the recording medium to record an image, the respective heat generating elements in one of a plurality of the heat generating element rows arrayed in the sub-scanning direction having length in the sub-scanning direction relatively different from that of the respective heat generating elements in the other heat generating element rows, the method including the steps of forming a dot in one dot line with an nth (n is a natural number) heat generating element among the heat generating elements in one of the heat generating element rows long in the sub-scanning direction and forming a dot in the same position in the identical dot line with an nth (n is a natural number) heat generating elements among the heat generating elements in the other of the heat generating element rows short in the sub-scanning direction.

(Action)

According to the embodiment, a dot in one dot line is formed by an nth (n is a natural number) heat generating element among the heat generating elements in one of the heat generating element rows long in the sub-scanning direction and a dot in the same position in the identical dot line is formed by an nth (n is a natural number) heat generating element among the heat generating elements in the other of the heat generating element rows short in the sub-scanning direction. Therefore, it is possible to cause, while taking into account responsiveness of the two heat generating elements having different lengths, the two heat generating elements to sharingly form a dot in the same position.

According to an embodiment of the present invention, it is possible to independently drive the heat generating elements having different lengths according to responsiveness of the heat generating elements such that the heat generating elements sharingly form a dot in the same position. According to another embodiment of the present invention, it is possible to cause, while taking into account responsiveness of the two heat generating elements having different lengths, the two heat generating elements to sharingly form a dot in the same position. Therefore, it is possible to prevent an excessive temperature rise of the thermal head and occurrence of "tailing" and the like. As a result, further deterioration in the thermal head is suppressed and the durable life of the thermal head is extended. Moreover, it is possible to obtain a high recording quality with high density.

DESCRIPTION OF THE PREFERRED EMBODIMENTS

Embodiments of the present invention will be hereinafter explained in detail with reference to the accompanying drawings. In the embodiments, a heat element is equivalent to a heat generating element and a heat element row is equivalent to a heat generating element row in the present invention.

Figure 1:
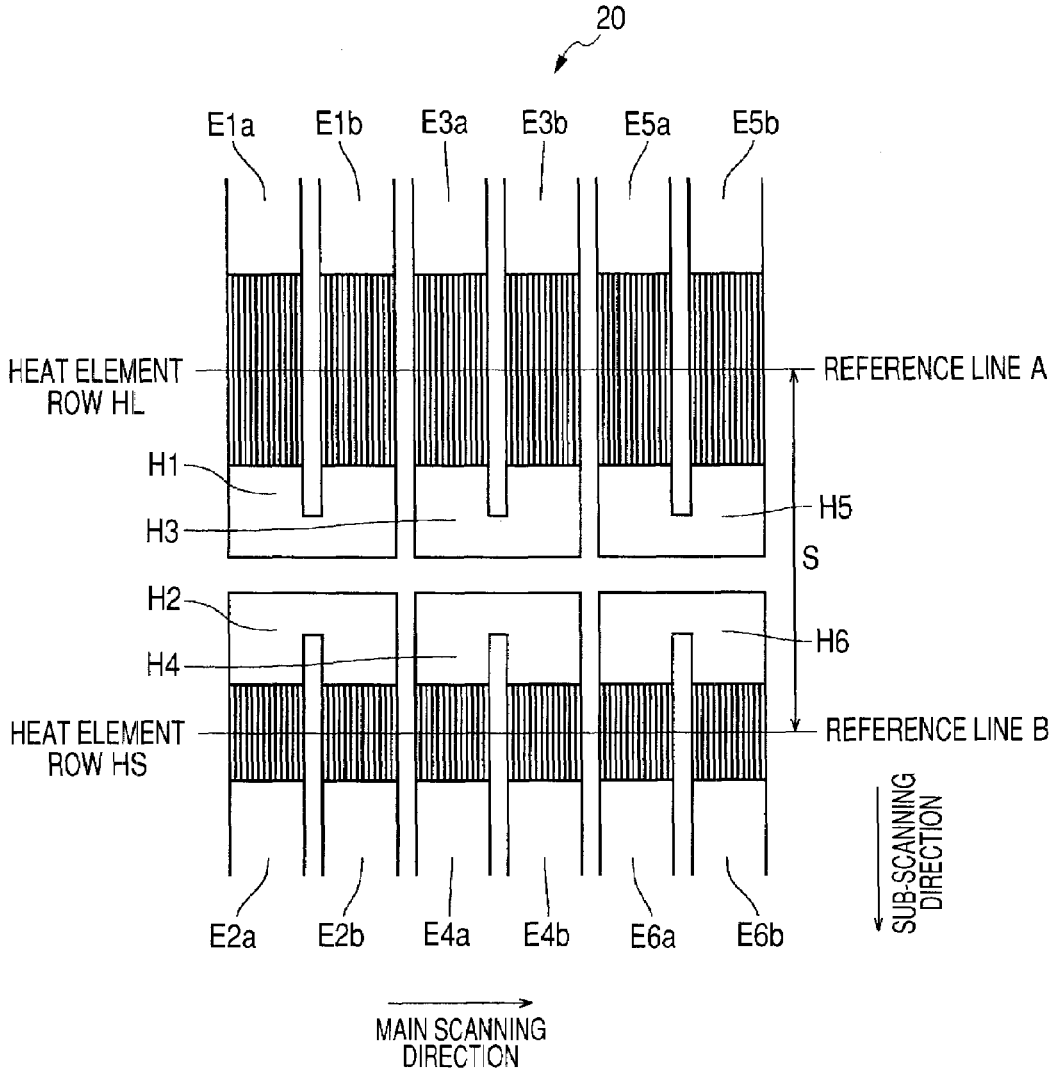
FIG. 1 is a plan view showing a thermal head according to an embodiment of the present invention.

FIG. 1 is a plan view showing a thermal head 20 according to an embodiment of the present invention.

As shown in FIG. 1, heat elements H (H1, H2, H3, H4, H5, H6, etc.) are arrayed in the thermal head 20 according to this embodiment. The heat elements H1, H3, H5, and the like are arrayed in a main scanning direction to form a heat element row HL. The heat elements H2, H4, H6, and the like are arrayed in the main scanning direction to form a heat element row HS. The resolution of the thermal head 20 is 300 DPI. 2560 heat elements H1, H3, H5, and the like and 2560 heat elements H2, H4, H6, and the like are arrayed in the heat element row HL and the heat element row HS, respectively.

The length in the sub-scanning direction of the respective heat elements H is relatively different in the heat element row HL on an upstream side and the heat element row HS on a downstream side in the sub-scanning direction. The heat elements H1, H3, H5, and the like forming the heat element row HL are relatively long in the sub-scanning direction. The heat elements H2, H4, H6, and the like forming the heat element row HS is relatively short in the sub-scanning direction.

The two heat elements H1 and H2, H3 and H4, H5 and H6, and the like opposed to each other, respectively, between the heat element row HL and the heat element row HS are arrayed to have an overlapping portion in the sub-scanning direction and not to have an overlapping portion in the sub-scanning direction with the other heat elements H (e.g., in the case of the heat element H1, the heat elements H4 and H6 excluding the heat element H2). Therefore, dot lines (sets of plural dots arranged in the sub-scanning direction on a recording sheet 40 (see FIG. 9)) arranged in the main scanning direction can be formed by nth (n is a natural number) two heat elements H1 and H2, H3 and H4, H5 and H6, and the like opposed to each other, respectively, between the heat element row HL and the heat element row HS. Moreover, a dot in the same position in an identical dot line can be formed by the nth two heat elements H1 and H2, H3 and H4, H5 and H6, and the like.

Furthermore, the heat element row HL and the heat element row HS are arranged to be shifted by length S in the sub-scanning direction. Therefore, there is a space S in the sub-scanning direction between a reference line A connecting the centers of the heat elements H1, H3, H5, and the like of the heat element row HL and a reference line B connecting the centers of the heat elements H2, H4, H6, and the like of the heat element row HS. The space S is n (n is a natural number) times as large as a pitch of dots (hereinafter referred to as dot pitch) formed in the sub-scanning direction of the recording sheet 40 (see FIG. 9). The centers of the heat elements H indicate points where generated thermal energy is the highest.

Figure 9:
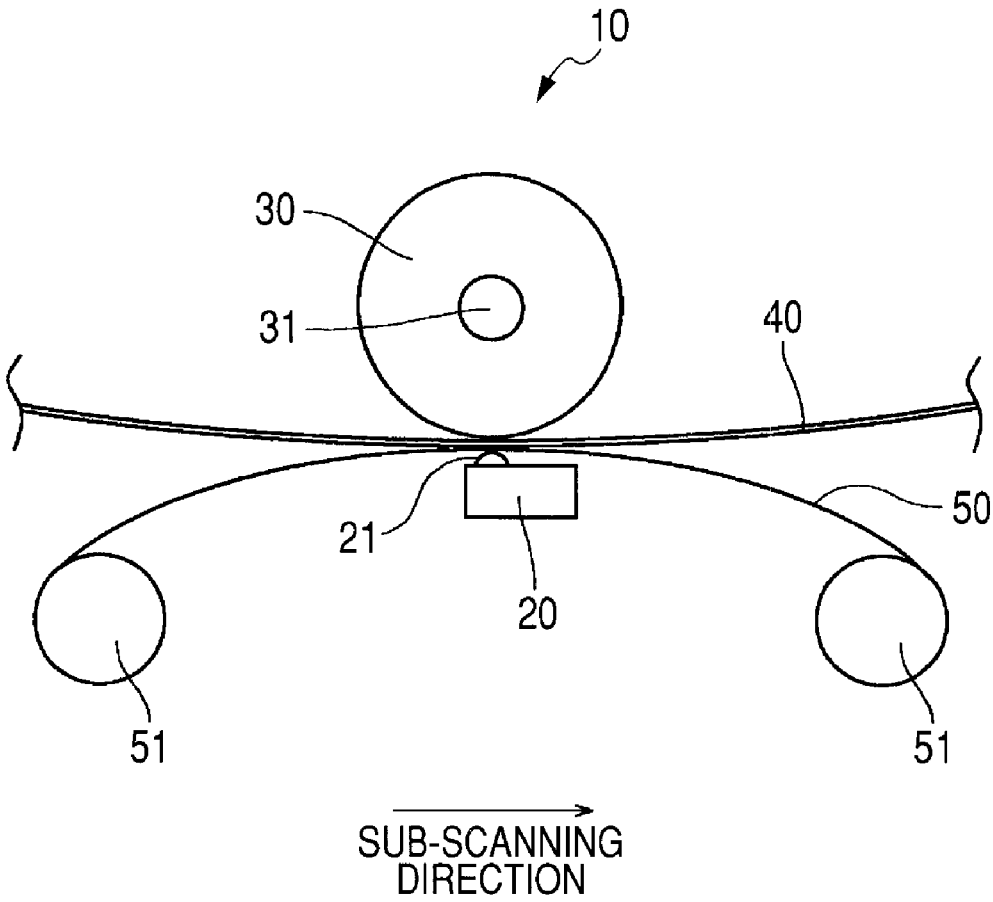
FIG. 9 is a schematic diagram showing a main part of a general thermal printer.
Figure 10:
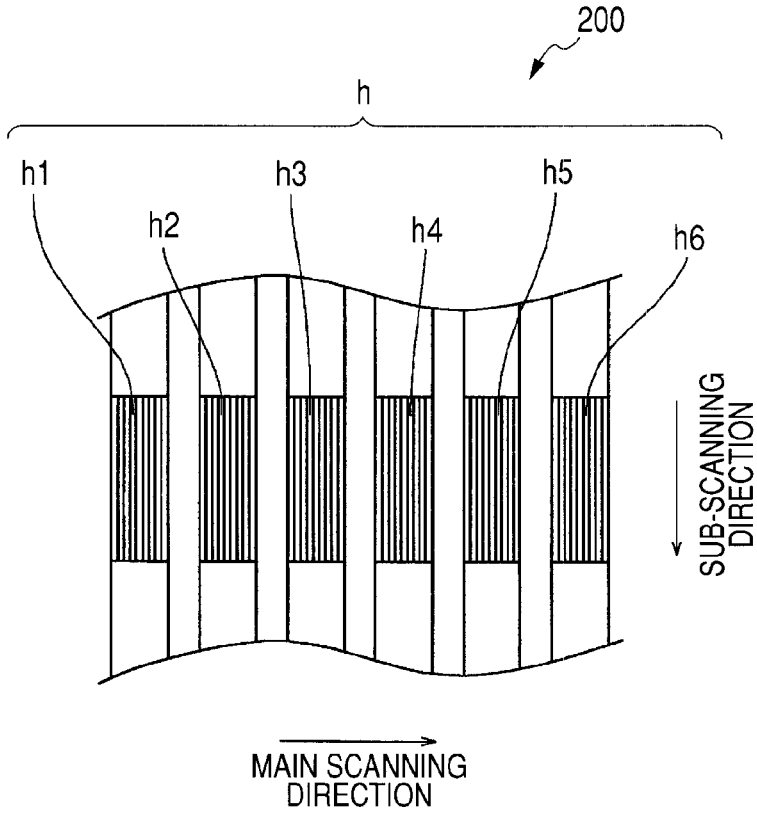
FIG. 10 is a plan view showing a thermal head in the past.
Figure 11:
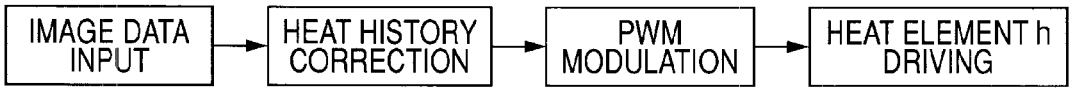
FIG. 11 is a block diagram showing a method of controlling the thermal head in the past.
Figure 12:
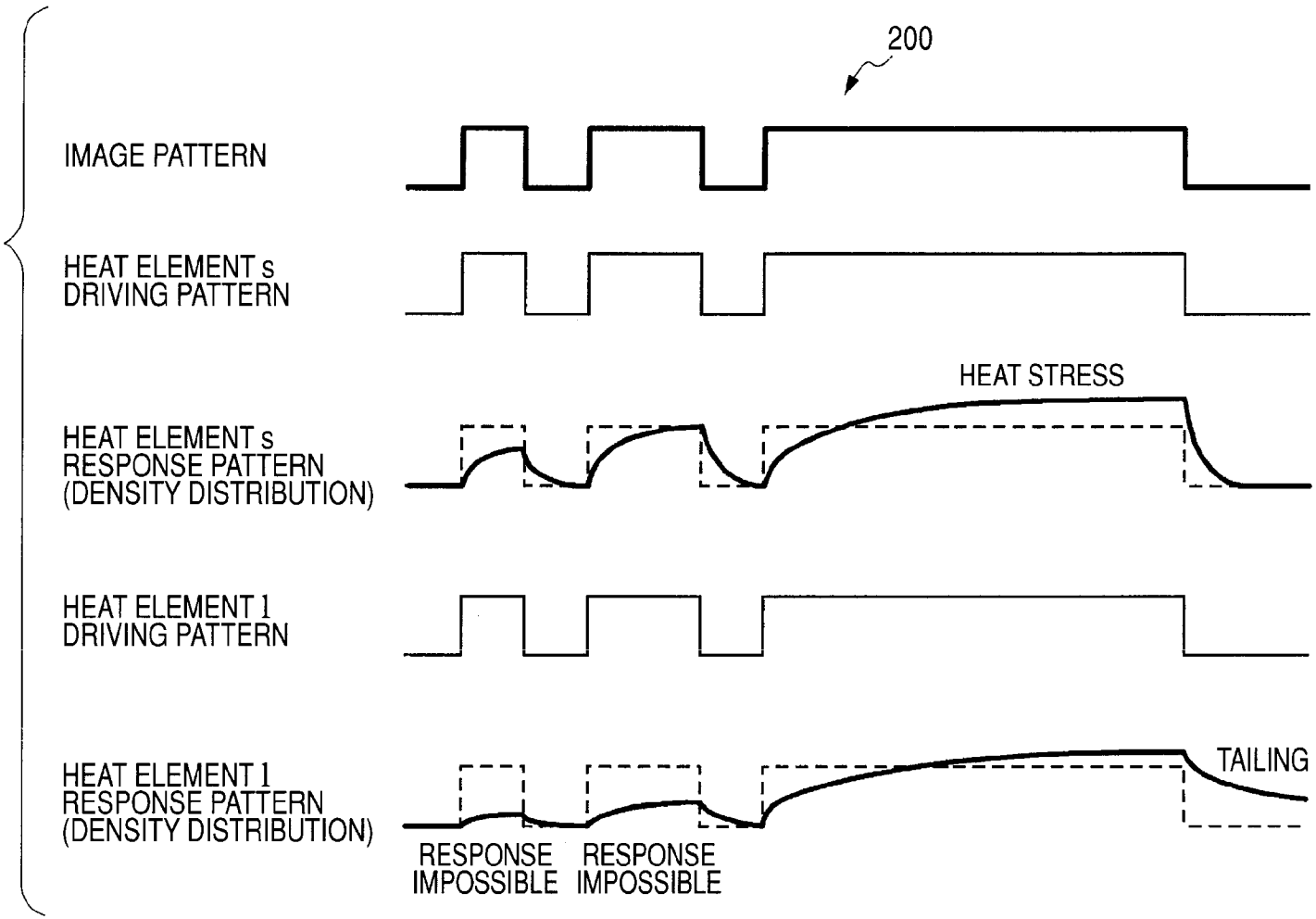
FIG. 12 is a conceptual diagram for explaining responsiveness (a density distribution) of another thermal head in the past.

When the space S is too large, the centers of the respective heat elements H substantially deviate from the top of a glaze 21 (see FIG. 9) and "contact" of the respective heat elements H (a proper angle of the respective heat elements H in contact with a platen roller 30 shown in FIG. 9) is deteriorated and adversely affects a recording quality. The "contact" has a close relation with a diameter and rubber hardness of the platen roller 30 in use, a pressing force of the thermal head 20, and the like. In the thermal head 20 according to this embodiment, taking into account these factors, the space S is set to be three times as large as the dot pitch to secure appropriate "contact". For example, when the dot pitch is 85 μm, the space S is 255 μm calculated from 85 μm×n (n=3).

Both ends of the heat elements H are connected to electrodes E1*a*, E1*b*, E2*a*, E2*b*, E3*a*, E3*b*, E4*a*, E4*b*, E5*a*, E5*b*, E6*a*, E6*b*, and the like, respectively. In the thermal head 20, drive ICs (not shown) for independently driving the heat element row HL and the heat element row HS, respectively, are mounted. The electrodes E1*a*, E2*a*, E3*a*, E4*a*, E5*a*, E6*a*, and the like are extended as common electrodes and the electrodes E1*b*, E2*b*, E3*b*, E4*b*, E5*b*, E6*b*, and the like are extended as individual electrodes in a direction of the respective drive ICs for independently driving the heat element row HL and the heat element row HS.

In this way, the thermal head 20 according to this embodiment can drive the two rows of the heat element row HL and the heat element row HS independently from each other. Thus, nth (n is a natural number) two heat elements H1 and H2, H3 and H4, H5 and H6, and the like in the heat element row HL and the heat element row HS can sharingly form dots in the same positions in an identical dot line, respectively.

A function sharing between the heat element row HL (the heat elements H1, H3, H5, and the like relatively long in the sub-scanning direction) and the heat element row HS (the heat elements H2, H4, H6, and the like relatively short in the sub-scanning direction) is explained below.

First, in the thermal head 20, in general, the length in the sub-scanning direction of the respective heat element H is formed relatively larger than the width in the main scanning direction thereof. This relates to responsiveness of the heat elements H and a method of controlling the thermal head 20. As described above, the thermal head 20 nips the recording sheet 40 (see FIG. 9) and the ink ribbon 50 (see FIG. 9) between the respective heat elements H and the platen roller 30 (see FIG. 9), conveys the recording sheet 40 and the ink ribbon 50 in a state in which the respective heat elements H are pressed, and controls to turn on and off the respective heat elements H according to dots formed on the recording sheet 40 to form a predetermined image.

In general, the respective heat elements H are arrayed in the main scanning direction and an array density thereof is matched with the resolution of the image printing specification in the thermal printer 10 (see FIG. 9). For example, when the printing is performed at 300 DPI according to the specification, the array density in the main scanning direction of the respective heat elements H is 300 DPI (about 84.7 μm).

Like the length in the main scanning direction, the length in the sub-scanning direction of the respective heat elements H should originally be length (about 84.7 μm) corresponding to a size of a "predetermined grid" (in this case, a grid for one dot of a printed image of 300 DPI). However, actually, in general, the length in the sub-scanning direction of the respective heat elements H is longer than this.

A reason for this is responsiveness of the heat elements H. The control of the thermal head 20 is control for raising, with heat generated, the temperature of the thermal head 20 to a predetermined temperature necessary for printing by turning on current supply to the heat elements H and lowering, by turning off the current supply, the temperature to a degree in which a dot is not formed. If both the raising and the lowering of the temperature are instantaneously performed, the length in the sub-scanning direction of the heat elements H may also be the length equivalent to the size of the "predetermined grid". However, actually, since the temperature does not instantaneously rise and fall, a temporal inclined area is present in raising and lowering temperature.

In this case, if the thermal head 20 is controlled to repeatedly perform a process of stopping media (the recording sheet 40 and the ink ribbon 50 shown in FIG. 9) according to respective dots in a dot line, forming dots in that state, and, thereafter, moving the "media" to a formation position of the next dot to form the dot in the stopped state again, it is possible to prevent the influence of the temporal inclined area in raising and lowering the temperature of the heat elements H. However, such a control method is unrealistic because a long time is necessary until final formation of an image and this is against the demand for high-speed recording.

Therefore, usually, it is a general practice to control, while conveying the "media" in the sub-scanning direction with respect to the respective heat elements H at constant speed, ON/OFF of the respective heat elements H in synchronization with the movement of the "media" to form a dot according to data of an image that should be formed. In order to improve the resolution in the sub-scanning direction, high energy is applied to the respective heat elements H such that the temperature thereof rises as instantaneously as possible.

However, since the application of the high energy to the heat elements H is a factor that gives thermal damage to the heat elements H, durability thereof is deteriorated. Therefore, in actuality, at some sacrifice of the resolution in the sub-scanning direction, the length in the sub-scanning direction of the heat elements H is secured, whereby the heat elements H are formed in a size with which an excessive temperature rise does not occur.

Consequently, an actual length in the sub-scanning direction of the heat elements H is considerably larger than the size of the "predetermined grid" corresponding to the resolution of the image printing specification. As a result, a thermofusible ink of a certain degree of density is transferred to a portion around an original dot that should be formed (a formation unnecessary portion). Therefore, in a strict sense, the resolution in the sub-scanning direction is inferior to the resolution in the main scanning direction.

Thus, in the thermal head 20 according to this embodiment, the respective heat elements H are arrayed in the two rows of the heat element row HL and the heat element row HS. Further, the length in the sub-scanning direction of the heat elements H1, H3, H5, and the like forming the heat element row HL is set relatively long and the length in the sub-scanning direction of the heat elements H2, H4, H6, and the like forming the heat element row HS is set relatively short. The heat element row HL and the heat element row HS are independently driven. In forming a dot in the same position in an identical dot line, the heat element row HL and the heat element row HS are optically controlled (function sharing) according to a state of the dot and dots around the dot (e.g., density information). This makes it possible to perform recording at high density and high resolution.

The concept of such optimum control (function sharing) is explained below.

When a natural image such as a general photograph is printed at 300 DPI, each of dots forming the image does not have different density. A group of dots in a wide area often have identical density (e.g., in the case of a human face, a portion of a cheek skin). On the other hand, there are also portions that need representation at considerably high resolution such as each piece of hair and downy hair. In these portions, density is different for each of narrow groups of dots. In other words, there are a low frequency component and a high frequency component in terms of a spatial frequency.

When it is assumed to draw such a natural image using paintbrushes, for example, it is a general practice to draw a skin color or the like of a skin portion using a rather thick brush and draw details such as a tip and the like of disheveled hair using a thin brush. Therefore, in drawing a picture, the low frequency component and the high frequency component in terms of a spatial frequency are separately recognized and, in order to optimally draw the respective components, two image forming tools, i.e., the thick brush and the thin brush are properly used. In some case, not only the two kinds of brushes, several kinds of paintbrushes with different thicknesses and shapes are properly used. However, here, the two kinds of brushes are used for simplification of explanation.

The thermal head 20 according to this embodiment is realized by applying such a concept to formation of a dot. The heat element row HL (long in the sub-scanning direction) is equivalent to the thick brush and the heat element row HS (short in the sub-scanning direction) is equivalent to the thin brush. The formation of a dot by the heat element row HL is performed at some sacrifice of the resolution in the sub-scanning direction. However, since the heat element row HL can keep in contact with the "media" for a relatively long time and transfer the thermofusible ink, it is possible to increase density. On the other hand, in the formation of a dot by the heat element row HS, since the heat element row HS can only transfer the thermofusible ink for a relatively short time, it is difficult to obtain high density but it is possible to improve the resolution in the sub-scanning direction.

Therefore, if the heat element row HL is used for low resolution and the heat element row HS is used for high resolution and function sharing is performed taking into account the difference of responsiveness to form a base for improvement of density with the heat element row HL and obtain high resolution with the heat element row HS, it is possible to realize both high density and high resolution (in particular, in the sub-scanning direction) in the heat element rows as a whole.

Figure 2:
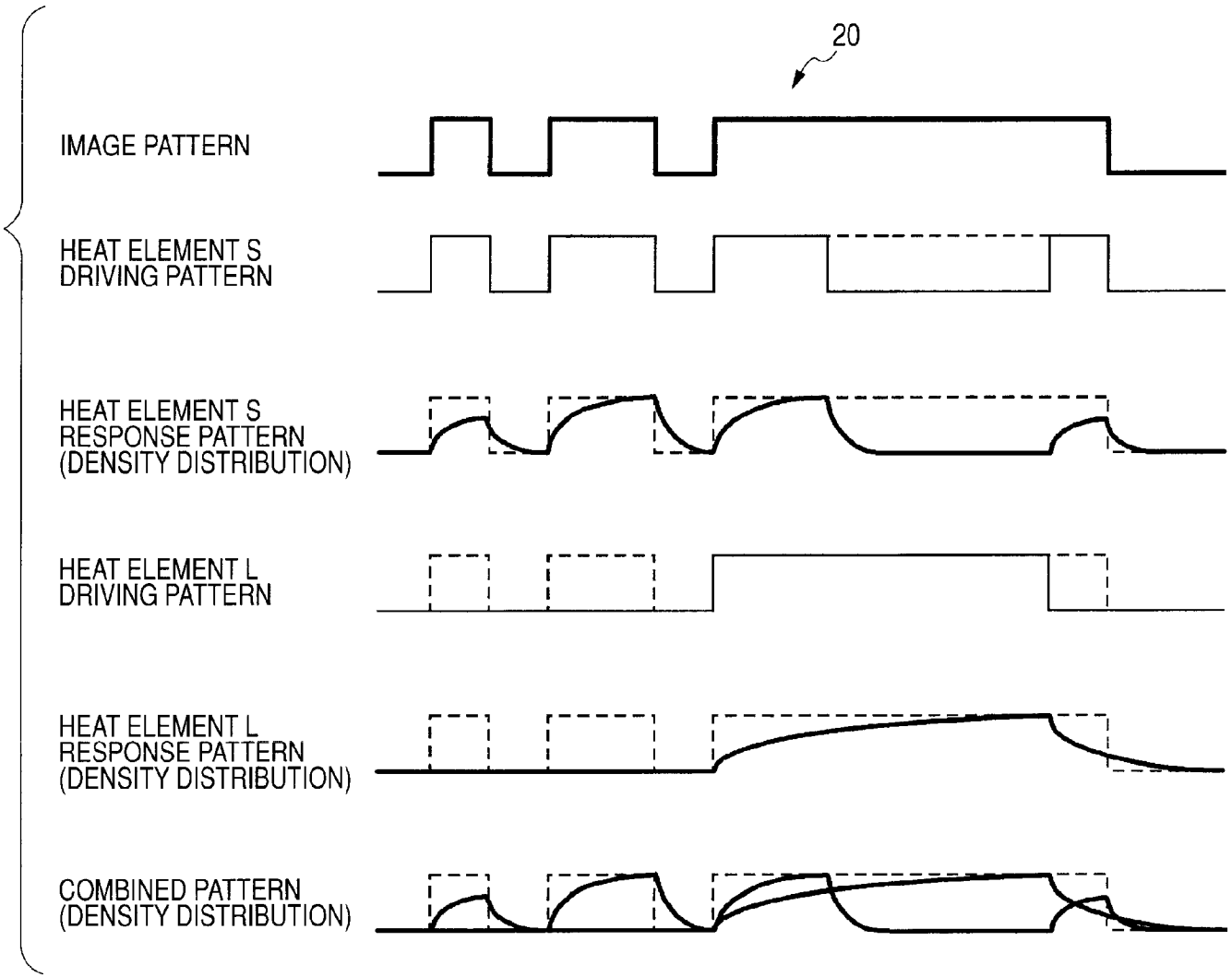
FIG. 2 is a conceptual diagram for explaining responsiveness (a density distribution) of the thermal head according to the embodiment.

FIG. 2 is a conceptual diagram for explaining responsiveness (a density distribution) of the thermal head 20 according to this embodiment.

In FIG. 2, the heat elements L are nth (n is a natural number) heat elements among the heat elements H1, H3, H5, and the like (see FIG. 1) in the heat element row HL relatively long in the sub-scanning direction. The heat elements S are nth (n is a natural number) heat elements among the heat elements H2, H4, H6, and the like (see FIG. 1) in the heat element row HS relatively short in the sub-scanning direction. A dot in one dot line is formed by the heat elements L and a dot in the same position in the identical dot line is formed by the heat elements S.

A driving pattern of the heat elements L is determined taking into account an image pattern and responsiveness of the heat elements L and a driving pattern of the heat elements S is determined taking into account the image pattern and responsiveness of the heat elements S (solid lines indicate the driving patterns corresponding to the image pattern indicated by dotted lines). Since the heat elements L are relatively slow in response, the heat elements L may be unable to respond in a portion corresponding to a short image pattern. Thus, the heat elements S is caused to cover this portion and the driving pattern of the heat elements L is not generated in this portion. In a portion corresponding to a long image pattern, necessary density can be obtained by the driving of the heat elements L. However, taking into account the slow fall of temperature, the driving pattern is finished early.

On the other hand, since the heat elements S are relatively fast in response, the heat elements S cover a portion that is not covered by the heat elements L and a portion where resolution is low. The heat elements S form a dot over a dot formed by the heat elements L to thereby realize both high density and high resolution. Specifically, the heat elements S not only cover the portion corresponding to the short image pattern but are also driven in the portion corresponding to the long image pattern during the start and during the end when the heat elements L may be unable to follow the long image pattern. When the driving pattern corresponds to the long image pattern, the heat elements S generate heat more than necessary. Thus, the heat elements L cover the middle portion of the long image pattern and the driving pattern of the heat elements S is not generated in the middle portion.

If the heat elements L and the heat elements S are controlled to share functions and to be combined (form dots in the same position), even in a portion of the long image pattern that is not sufficiently treated in the past, it is possible to form a high-density dot with the heat elements L and form a high-resolution dot with the heat elements S. Moreover, "tailing" due to the heat elements L does not occur and there is no heat stress of the heat elements S.

Figure 3A:
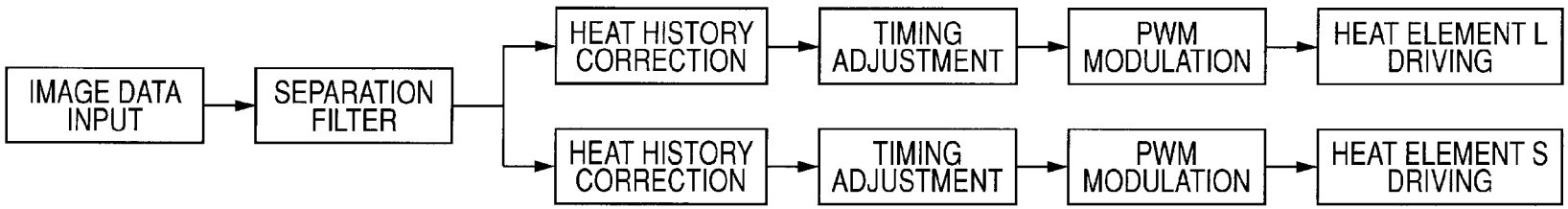
FIGS. 3A and 3B are block diagrams showing a method of controlling the thermal head according to the embodiment.
Figure 3B:
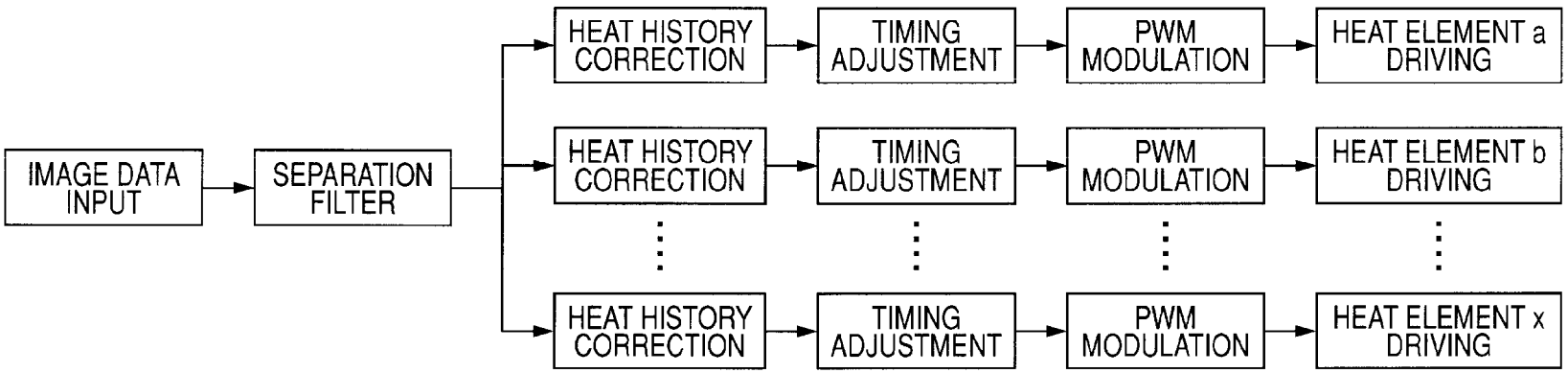

FIGS. 3A and 3B are block diagrams showing a method of controlling the thermal head 20 according to this embodiment.

As shown in FIG. 3A, when data of an image that should be formed is inputted, the image data is decomposed into data for the heat elements L and data for the heat elements S by a separation filter according to responsiveness of the heat elements L and the heat elements S. Heat history correction is separately applied to the data for the heat elements L and the data for the heat elements S. After timing adjustment is applied the respective data subjected to the heat history correction, the data for the heat elements L and the heat elements S are modulated into data for driving by PWM modulation. Dots in the same position are formed by driving of the heat elements L and the heat elements S based on the modulated data. An overall image is formed by sets of such dots. Such a method of controlling the thermal head 20 is not limited to the case of the two kinds of heat elements, i.e., the heat elements S and the heat elements L (the heat element row HL and the heat element row HS in the two rows) and can be applied in the same manner if the kinds of heat elements increase as shown in FIG. 3B.

Figure 4A:
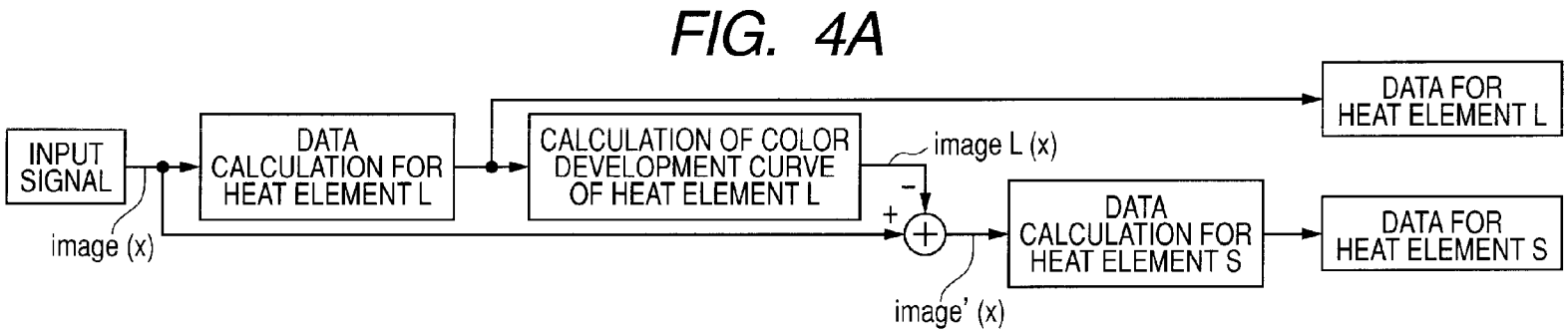
FIGS. 4A and 4B are block diagrams showing operations of a separation filter in the method of controlling the thermal head according to the embodiment.
Figure 4B:
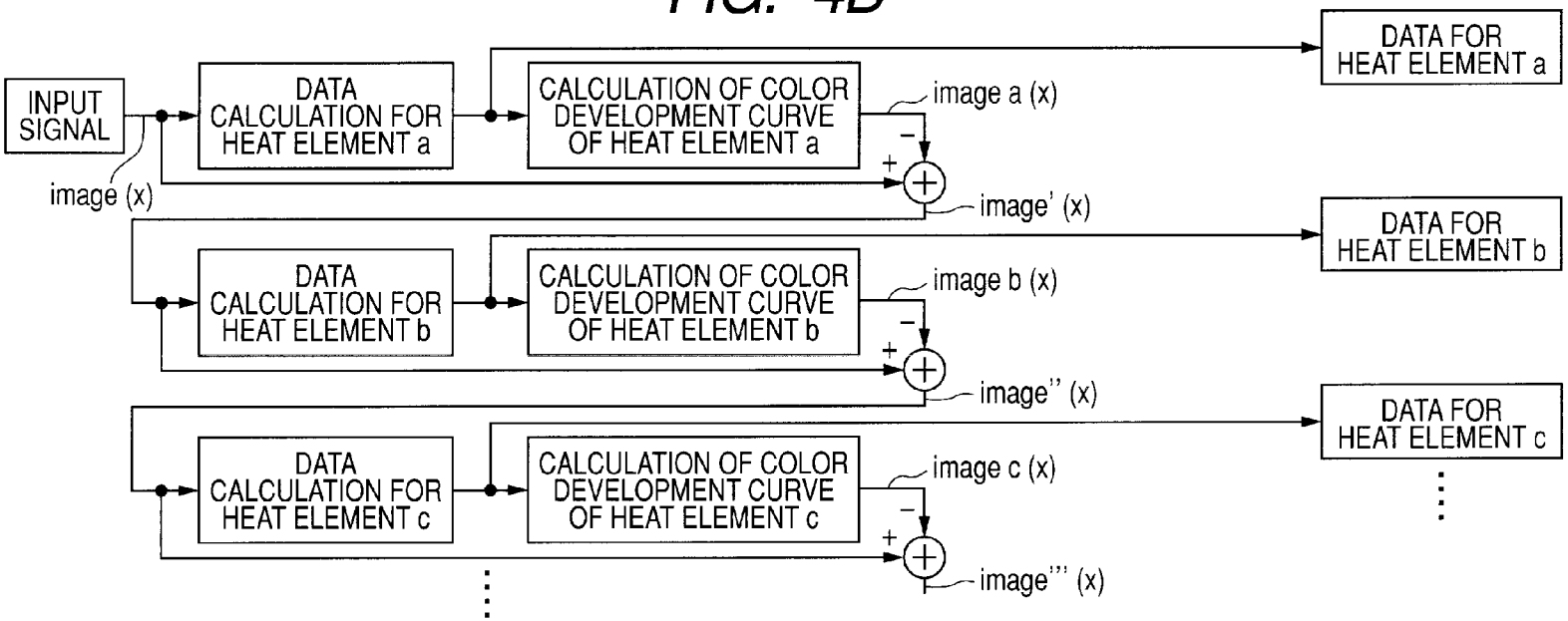

FIGS. 4A and 4B are block diagrams showing operation of the separation filter in the method of controlling the thermal head 20 according to this embodiment.

Figure 5A:
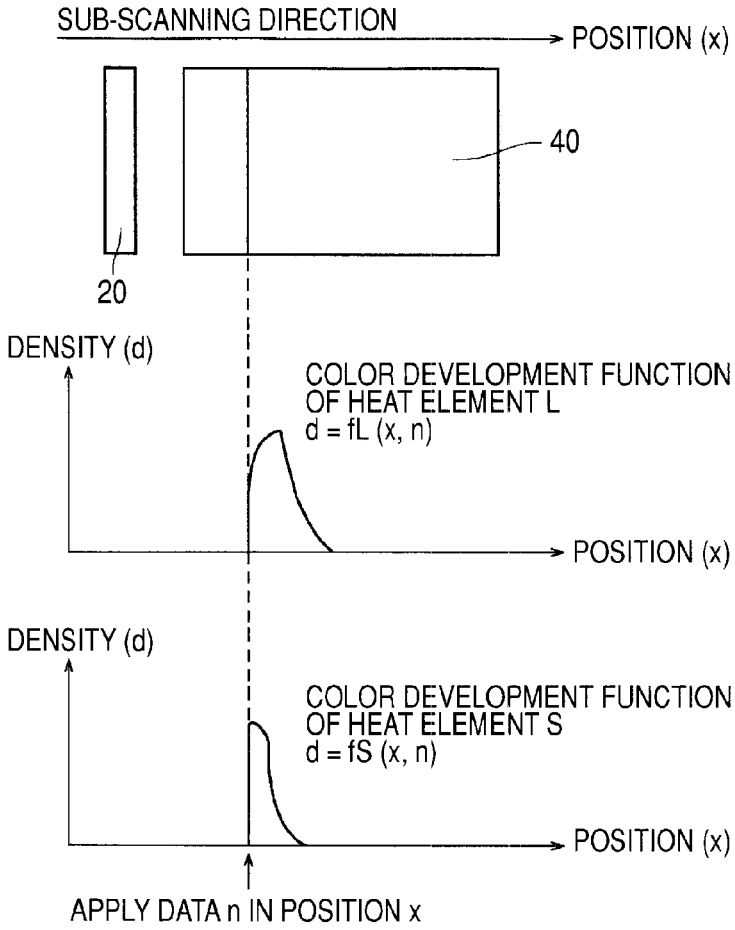
FIGS. 5A and 5B are graphs showing a function of the separation filter shown in FIGS. 4A and 4B.
Figure 5B:
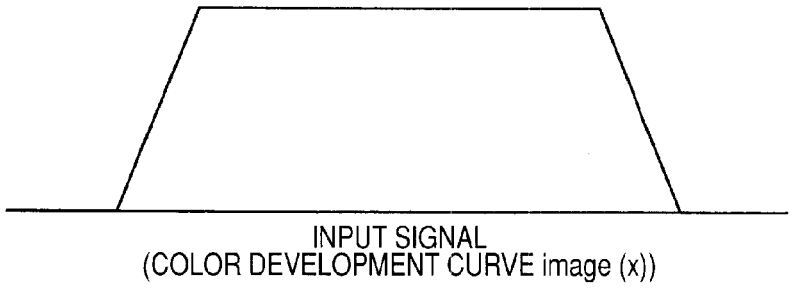
Figure 6A:
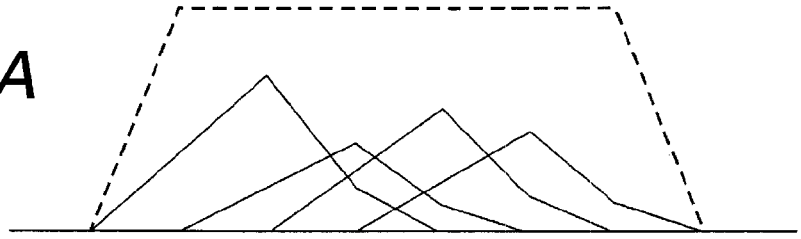
FIGS. 6A to 6C are graphs showing processing states of the separation filter following FIGS. 5A to 5B.
Figure 6B:
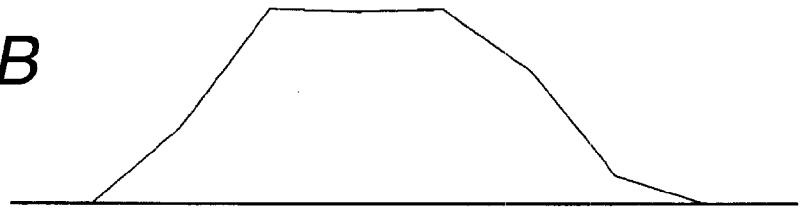
Figure 6C:
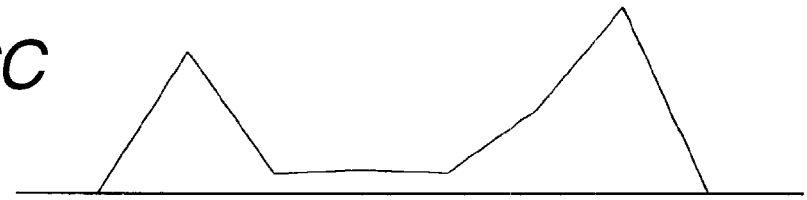
Figure 7A:
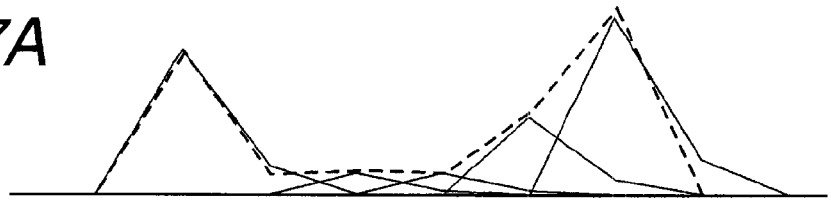
FIGS. 7A to 7C are graphs showing processing states of the separation filter following FIGS. 6A to 6C.
Figure 7B:
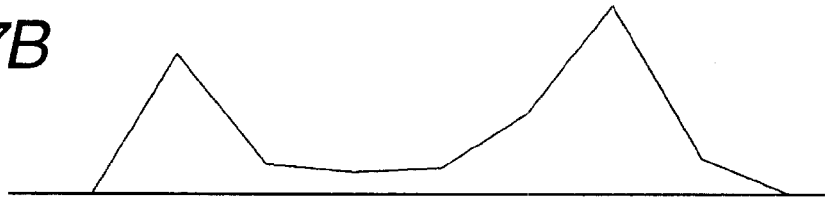
Figure 7C:
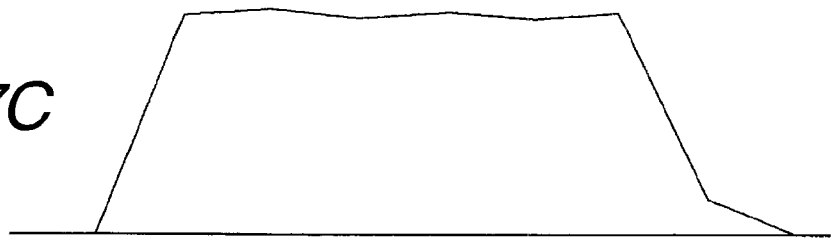

FIGS. 5A and 5B are graphs showing functions of the separation filter shown in FIGS. 4A and 4B. FIGS. 6A to 6C are graphs showing processing states of the separation filter following FIGS. 5A and 5B. FIGS. 7A to 7C are graphs showing processing states of the separation filter following FIGS. 6A to 6C.

As shown in FIG. 4A, the separation filter decomposes the data for the heat elements L long in the sub-scanning direction earlier and decomposes the data for the heat elements S short in the sub-scanning direction later. As shown in FIG. 5A, the decomposition of the data is executed in a processing procedure described below according to a color development function d=fL(x,n) of the heat elements L and a color development function d=fS(x,n) of the heat elements S, where x is a position in the sub-scanning direction, d is density, and n is applied data. It is assumed that image(x) as an input signal (a color development curve expected from input data) is a curve shown in FIG. 5B.

First, the separation filter shown in FIG. 4A decomposes the color development curve image(x) as the input signal into data for the heat elements L. In respective positions "x", maximum applied data "n" is calculated in a range in which a sum calculated from the color development function d=fL(x, n) of the heat elements L is not larger than input signal image(x) (see FIG. 6A). The separation filter calculates (composes) a color development curve imageL(x) of the heat elements L on the basis of the data shown in FIG. 6A decomposed in this way (see FIG. 6B). The separation filter subtracts the color development curve imageL(x) of the heat elements L from the input signal image(x) and obtains image' (x) shown in FIG. 6C.

Subsequently, the separation filter decomposes the image' (x) into data for the heat elements S. The separation filter calculates maximum applied data "n" in a range in which a sum calculated from the color development function d=fS(x, n) of the heat elements S is not larger than image' (x) (see FIG. 7A). The separation filter calculates (composes) a color development curve imageS(x) of the heat element S on the basis of the data shown in FIG. 7A decomposed in this way (see FIG. 7B).

As described above, the input signal image(x) is decomposed into the color development curve imageL(x) of the heat elements L and the color development curve imageS(x) of the heat elements S by the separation filter shown in FIG. 4A. A sum of imageL(x) and imageS(x) is a final color development curve. As shown in FIG. 7C, this color development curve is extremely approximate to the color development curve of the input signal (see FIG. 5B). Therefore, according to the combination of the heat elements L and the heat elements S (formation of dots in the same position), it is possible to obtain a high recording quality with high density. Such operations of the separation filter is not limited to the case of the two kinds of heat elements, i.e., the heat elements S and the heat elements L (the heat element row HL and the heat element row HS in the two rows shown in FIG. 1) and can be applied in the same manner if the kinds of heat elements increase as shown in FIG. 4B.

Figure 8:
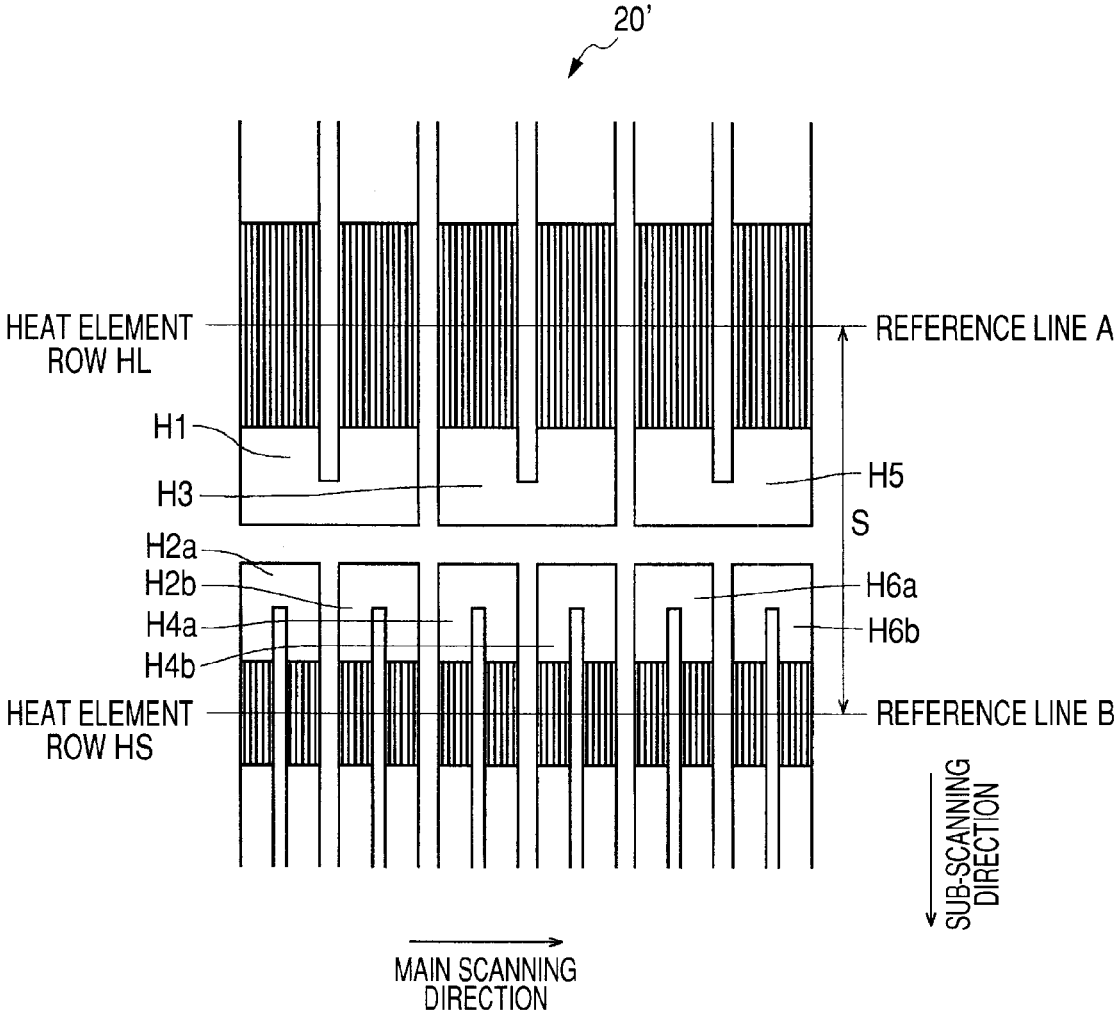
FIG. 8 is a plan view showing a thermal head according to another embodiment of the present invention.

FIG. 8 is a plan view showing a thermal head 20' according to another embodiment of the present invention.

The thermal head 20' according to this embodiment shown in FIG. 8 has the resolution (600 DPI) in the main scanning direction of the heat element row HS short in the sub-scanning direction twice as large as that of the thermal head 20 according to the embodiment shown in FIG. 1. Two heat elements H2*a* and H2*b* narrow in the main scanning direction are opposed to the heat element H1 of the heat element row HL long in the sub-scanning direction. Similarly, heat elements H4*a* and H4*b* are opposed to the heat element H3 and heat elements H6*a* and H6*b* are opposed to the heat element H5.

In this way, the resolution in the main scanning direction of the heat element row HS that carries out printing in a high frequency portion in a spatial frequency of an image is higher than that of the heat element row HL. Thus, it is possible to increase the resolution of a printed image in the main scanning direction. Therefore, the thermal head 20' according to this embodiment shown in FIG. 8 can perform print representation of an image with the improved resolution compared with the thermal head 20 according to the embodiment shown in FIG. 1.

In the thermal head 20' according to this embodiment shown in FIG. 8, a ratio between the length in the sub-scanning direction and the width in the main scanning direction (an aspect ratio) is set equal in the heat element row HL long in the sub-scanning direction and the heat element row HS short in the sub-scanning direction. Therefore, resistances of the respective heat elements H are fixed. When the width in the main scanning direction is identical and only the length in the sub-scanning direction is simply reduced, the resistances of the respective heat elements H are different in the heat element row HL and the heat element row HS. Therefore, it is necessary to change an applied voltage in driving the heat elements H. However, if the resistances are fixed, it is easy to drive the respective heat elements H and the structure of the thermal head 20' is simple and is advantageous in terms of cost. Creation of data for the heat element row HL and the heat element row HS is two-dimensional extension of the creation of data by the thermal head 20 according to the embodiment shown in FIG. 1.

As described above, the thermal head 20 (the thermal head 20') according to the embodiment can independently form one dot with the heat element row HL (for low resolution) and the heat element row HS (for high resolution). Thus, it is possible to perform printing that realizes both high resolution and high density. As shown in FIGS. 4A and 4B, the separation filter that creates data for the heat element row HL (the heat elements L) and data for the heat element row HS (the heat elements S) can maximize a usage rate of the heat element row HL (for low resolution) by creating the data for the heat elements L earlier. Thus, thermal damage to the "media" and damage to the heat element row HS due to the heat element row HS (for high resolution) are reduced.

The embodiments of the present invention have been explained. However, the present invention is not limited to the embodiments described above. For example, various modifications described below are possible.

(1) In the embodiments described above, the two heat element rows HL and HS share functions and form an identical dot. However, even if separate dots are formed, since the formation of the dots is shared by the two heat element rows HL and HS, it is possible to prevent an excessive temperature rise of the thermal head 20.

(2) It is possible to properly use the heat element row HL and the heat element row HS in a high-density portion and a high-resolution portion.

It should be understood by those skilled in the art that various modifications, combinations, sub-combinations, and alterations may occur depending on design requirements and other factors insofar as they are within the scope of the appended claims or the equivalents thereof.

What is claimed is:

1. A thermal head, comprising: a plurality of heat generating elements arrayed therein in a main scanning direction to form a plurality of heat generating element rows, and a controller operatively configured to independently drive each of the heat generating rows and to causes the respective heat generating elements to generate heat while conveying a recording medium in a sub-scanning direction, and to forms plural dot lines, which are sets of plural dots arranged in the sub-scanning direction, in the main scanning direction on the recording medium to record an image, wherein:

the plurality of the heat generating element rows are arrayed in the sub-scanning direction, the respective heat generating elements in one of the heat generating element rows have length in the sub-scanning direction relatively different from that of the respective heat generating elements in another of the heat generating element rows, and respective nth (n is a natural number) heat generating elements among the heat generating elements in the one and the other heat generating element rows sharingly form a dot in the same position in an identical dot line according to independent driving for each of the heat generating element rows by the controller.

2. A thermal head according to claim 1, wherein the respective heat generating elements short in the sub-scanning direction are narrow in the main scanning direction compared with the other respective heat generating elements.

3. A thermal head according to claim 1, wherein the respective heat generating elements short in the sub-scanning direction have high resolution in the main scanning direction compared with the other respective heat generating elements.

4. A thermal head according to claim 1, wherein the respective heat generating elements have an equal ratio between length in the sub-scanning direction and width in the main scanning direction.

5. A method of controlling a thermal head that has plural heat generating elements arrayed therein in a main scanning direction to form a heat generating element row, causes the respective heat generating elements to generate heat while conveying a recording medium in a sub-scanning direction, and forms plural dot lines, which are sets of plural dots arranged in the sub-scanning direction, in the main scanning direction on the recording medium to record an image, the respective heat generating elements in one of a plurality of the heat generating element rows arrayed in the sub-scanning direction having length in the sub-scanning direction relatively different from that of the respective heat generating elements in the other heat generating element rows, the method comprising the steps of: forming a dot in one dot line with an nth (n is a natural number) heat generating element among the heat generating elements in one of the heat generating element rows long in the sub-scanning direction; and forming a dot in the same position in the identical dot line with an nth (n is a natural number) heat generating element among the heat generating elements in the other of the heat generating element rows short in the sub-scanning direction.

6. A method of controlling a thermal head according to claim 5, wherein the respective heat generating elements long in the sub-scanning direction form a dot at low resolution, and the respective heat generating elements short in the sub-scanning direction form a dot at high resolution.

7. A method of controlling a thermal head according to claim 5, wherein the thermal head includes a separation filter that decomposes, for each of the heat generating element row, data of a dot that should be formed, and data for the heat generating element row in which the respective heat generating elements long in the sub-scanning direction are arrayed is decomposed earlier and data for the heat generating element row in which the respective heat generating elements short in the sub-scanning direction are arrayed is decomposed later by the separation filter.

* * * * *